US010511902B2

(12) United States Patent
Yamada et al.

(10) Patent No.: US 10,511,902 B2
(45) Date of Patent: Dec. 17, 2019

(54) ACOUSTIC TRANSDUCER

(71) Applicant: SONY CORPORATION, Tokyo (JP)

(72) Inventors: Yuuji Yamada, Tokyo (JP); Koyuru Okimoto, Tokyo (JP); Yoshio Ohashi, Kanagawa (JP); Toshiyuki Nakagawa, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 74 days.

(21) Appl. No.: 15/520,453

(22) PCT Filed: Jul. 15, 2015

(86) PCT No.: PCT/JP2015/070303
§ 371 (c)(1),
(2) Date: Apr. 20, 2017

(87) PCT Pub. No.: WO2016/067681
PCT Pub. Date: May 6, 2016

(65) Prior Publication Data

US 2017/0318373 A1 Nov. 2, 2017

(30) Foreign Application Priority Data

Oct. 31, 2014 (JP) ..... 2014-223345

(51) Int. Cl.
*H04R 25/00* (2006.01)
*H04R 1/10* (2006.01)
(Continued)

(52) U.S. Cl.
CPC ..... *H04R 1/1016* (2013.01); *H04R 1/1058* (2013.01); *H04R 1/1083* (2013.01);
(Continued)

(58) Field of Classification Search
CPC combination set(s) only.
See application file for complete search history.

(56) References Cited

U.S. PATENT DOCUMENTS 5,022,486 A * 6/1991 Miura ..... G10K 11/22 181/132
8,798,298 B1 * 8/2014 Burns ..... H04R 1/2876 264/267
2007/0195984 A1 * 8/2007 Yang ..... H04R 1/1075 381/372

FOREIGN PATENT DOCUMENTS

JP 02-116296 A 4/1990
JP 2829982 B2 12/1998
(Continued)

*Primary Examiner* — Amir H Etesam
(74) *Attorney, Agent, or Firm* — Chip Law Group

(57) ABSTRACT

Provided is an acoustic transducer which is used by being fitted into an ear of a listener, is formed in a compact and lightweight shape, and preferably prevents re-reflection of a sound wave. An acoustic transducer 100 is formed of a film-shaped material having an expanding and contracting action and includes a cylindrical acoustic transducing element 101. The cylindrical acoustic transducing element 101 also functions as a sound guide tube. The acoustic transducing element 101 prevents re-reflection of the sound wave reflected by an eardrum when the sound wave has been generated and prevents localization phenomenon and a feeling of pressure in auditory sense. Also, since the acoustic transducing element 101 is formed in a compact and lightweight shape, the acoustic transducing element 101 generates the sound wave for directly reaching the eardrum or collects the sound at a place near the eardrum without a feeling of foreign materials in a case where a person wears the acoustic transducing element 101 the an ear.

18 Claims, 19 Drawing Sheets

(51) Int. Cl.
*H04R 17/00* (2006.01)
*H04R 17/02* (2006.01)

(52) U.S. Cl.
CPC ..... *H04R 17/005* (2013.01); *H04R 17/025* (2013.01); *H04R 2400/01* (2013.01); *H04R 2460/13* (2013.01)

(56) References Cited

FOREIGN PATENT DOCUMENTS

| | | | |
|---|---|---|---|
| JP | 2001-326985 | A | 11/2001 |
| JP | 2004-208220 | A | 7/2004 |
| JP | 2007-189468 | A | 7/2007 |
| JP | 2009-059842 | A | 3/2009 |
| JP | 2014-014063 | A | 1/2014 |

* cited by examiner

ACOUSTIC TRANSDUCER

CROSS REFERENCE TO RELATED APPLICATIONS

This application is a U.S. National Phase of International Patent Application No. PCT/JP2015/070303 filed on Jul. 15, 2015, which claims priority benefit of Japanese Patent Application No. JP 2014-223345 filed in the Japan Patent Office on Oct. 31, 2014. Each of the above-referenced applications is hereby incorporated herein by reference in its entirety.

TECHNICAL FIELD

The technology disclosed herein relates to an acoustic transducer which is fitted into an ear of a listener and converts an electric signal into a sound wave or converts a sound wave into an electric signal.

BACKGROUND ART

A compact acoustic transducer, that is, an earphone has been widely used which converts electric signals output from a reproduction apparatus and a receiver into an acoustic signal by a speaker near an ear or an eardrum. This kind of the sound reproduction apparatus generates a sound so that a listener who wears the reproduction apparatus can listen to the sound. Therefore, the sound reproduction apparatus is used in various environments.

Many of currently popular earphones have shapes to be inserted into the ear of the listener. For example, an inner ear type earphone has a shape to be hooked on an auricle of the listener. Also, a canal type earphone has a shape used by being deeply inserted into a hole of the ear (ear canal). Also, the canal type earphone often has a closed structure and has relatively good sound insulating performance. Therefore, with the canal type earphone, there is a merit that the listener can enjoy music in a slightly noisy place.

In general, the canal type earphone includes a speaker unit for converting an electric signal into an acoustic signal and a substantially cylindrical housing which is also used as an acoustic tube as basic components, and the speaker unit is attached to one end (outer side of ear canal) of the housing. In the housing, a radiation exit is provided which radiates air vibration generated by the speaker unit to the ear canal and transmits the air vibration to an eardrum. Also, an earpiece (detachable component) is attached to another end (part inserted into ear canal) of the housing. The earpiece normally has a shape which matches the ear canal when the listener wears the earpiece.

For example, a canal type earphone device has been proposed which can house a housing in a cavum conchae and can arrange an acoustic tube to an ear canal entrance by obliquely arranging the acoustic tube from a position shifted from the center of the housing (for example, refer to Patent Document 1).

It is necessary for the canal type earphone, at a minimum, to include the speaker unit and the housing to which the speaker is attached and which contains the speaker and obtains an acoustic characteristic at the same time. In other words, the canal type earphone needs to have a weight of the speaker unit and the housing and needs to have a volume of the housing. This causes a feeling of foreign materials to remain when the user wears the earphone on the ear.

Also, with the traditional earphone device (including inner ear type and canal type), basically, a sound generated by the speaker unit passes through the earphone housing and the ear canal and reaches the eardrum. Then, the sound vibrates the eardrum so that the user listens to the sound.

Also, the sound which has reached the eardrum is reflected by the eardrum and travels in the reverse direction in the ear canal to get outside. However, many of the traditional earphone devices have a configuration in which the earphone housing is worn on a place near the auricle so as to cover the ear canal entrance. Therefore, the sound (reflected sound from eardrum) which is getting outside of the ear canal is reflected by the earphone housing and the speaker unit in the housing and enters the ear canal toward the eardrum again.

In a word, due to the repetition of the reflection, when the traditional earphone device is used, two kinds of sounds, i.e., the sound which has been directly entered from the speaker unit to the eardrum and the sound which has been reflected by the eardrum once and reflected by the earphone housing and the like again, are listened. When a time interval between the directly entered sound and the reflected sound is equal to or shorter than several hundred microseconds, the time interval is turned into localization phenomenon and a feeling of pressure in auditory sense and acts on the user. Therefore, this inhibits listening to the sound as an excellent reproduced sound.

An earphone device for using an acoustic tube having a non-reflection end to prevent the sound reflected by the eardrum from being re-reflected by the earphone housing and the like has been known. The inside of this kind of acoustic tube is basically the same as a free space. A traveling wave of the sound wave (audible sound) generated from the speaker provided at one end of the acoustic tube is propagated, and a reflected wave is not generated. Therefore, the above earphone device becomes a non-reflection earphone.

For example, an acoustic reproduction apparatus has been proposed which includes an acoustic tube formed to have an inner diameter substantially the same as that of an ear canal and a speaker unit attached in a state where a sound emitting surface is faced to an inner wall surface of the acoustic tube (refer to Patent Document 2). Also, in the acoustic reproduction apparatus, an internal circumference area including the sound emitting surface of the speaker unit of the acoustic tube is substantially the same as an internal circumference area which does not include the sound emitting surface of the speaker unit of the acoustic tube. Also, one end of the acoustic tube is a part fitted into an auricle, and the other end is a sound non-reflection end. According to the acoustic reproduction apparatus, the voice emitted from the speaker unit reaches the eardrum through the acoustic tube, and the voice is reflected to the non-reflection side of the acoustic tube after being listened by the eardrum. Therefore, the voice is not reflected toward the eardrum side and is not listened again.

However, although the acoustic reproduction apparatus for using the acoustic tube can remove the effect of the reflected sound, the acoustic reproduction apparatus needs to include the acoustic tube in addition to the speaker unit. Also, the weight and the volume of the speaker and the housing cause the feeling of foreign materials to remain when the user wears the acoustic reproduction apparatus on the ear.

SUMMARY OF THE INVENTION

Problems to be Solved by the Invention

A purpose of the technology disclosed herein is to provide a compact, lightweight, and excellent acoustic transducer used by being worn on an ear of a listener.

Another purpose of the technology disclosed herein is to provide an excellent acoustic transducer which is used by being worn on an ear of a listener, is formed in a compact and lightweight shape, and can preferably prevent re-reflection of a sound wave.

Solutions to Problems

The technology disclosed herein has been made to solve the above problems. A first aspect is an acoustic transducer including an acoustic transducing unit which is formed to have an inner diameter almost the same as an inner diameter of an ear canal of a person and has an expanding and contracting action and a part inserted into an ear canal which is provided at least one end of the acoustic transducing unit.

According to a second aspect of the technology disclosed herein, both exits of the acoustic transducing unit of the acoustic transducer according to the first aspect are opened.

According to a third aspect of the technology disclosed herein, the acoustic transducer according to the first aspect further includes a fitting member in the part inserted into an ear canal.

According to a fourth aspect of the technology disclosed herein, the acoustic transducing unit of the acoustic transducer according to the first aspect is closed.

According to a fifth aspect of the technology disclosed herein, the acoustic transducing unit of the acoustic transducer according to the first aspect is closed, and both ends of the acoustic transducing unit are parts inserted into ear canals.

According to a sixth aspect of the technology disclosed herein, one end of the acoustic transducing unit of the acoustic transducer according to the first aspect is closed, and the other end is the part inserted into an ear canal.

According to a seventh aspect of the technology disclosed herein, the acoustic transducing unit of the acoustic transducer according to the first aspect is closed, and a closed position is variable.

According to an eighth aspect of the technology disclosed herein, the acoustic transducer according to the fourth aspect further includes an acoustic material for sealing an inside or the end of the acoustic transducing unit.

According to a ninth aspect of the technology disclosed herein, the inside of the acoustic transducing unit of the acoustic transducer according to the first aspect has an almost uniform cross-sectional area in a longitudinal direction.

According to a tenth aspect of the technology disclosed herein, the cross-sectional area of the inside of the acoustic transducing unit of the acoustic transducer according to the first aspect is formed to be gradually decreased in the longitudinal direction.

According to an eleventh aspect of the technology disclosed herein, the acoustic transducer according to the first aspect has an external housing on an outside of the acoustic transducing unit.

According to a twelfth aspect of the technology disclosed herein, the external housing of the acoustic transducer according to the eleventh aspect is formed to close an exit on an opposite side of the part inserted into an ear canal of the acoustic transducing unit.

According to a thirteenth aspect of the technology disclosed herein, the external housing of the acoustic transducer according to the eleventh aspect is formed to have an inner diameter larger than an outer shape of the acoustic transducing unit and to hold the acoustic transducing unit by inserting the acoustic transducing unit into the external housing.

According to a fourteenth aspect of the technology disclosed herein, the acoustic transducer according to the eleventh aspect further includes an acoustic material in a gap between the external housing and the acoustic transducing unit.

According to a fifteenth aspect of the technology disclosed herein, the acoustic transducing unit of the acoustic transducer according to the first aspect is formed to function as a reproduction device.

According to a sixteenth aspect of the technology disclosed herein, the acoustic transducing unit of the acoustic transducer according to the first aspect is formed to function as a sound collection device.

According to a seventeenth aspect of the technology disclosed herein, the acoustic transducing unit of the acoustic transducer according to the first aspect is formed to function as either the reproduction device or the sound collection device.

According to an eighteenth aspect of the technology disclosed herein, the acoustic transducing unit of the acoustic transducer according to the first aspect is formed of a sheet-shaped flexible device having an expanding and contracting action according to an electric signal.

Effects of the Invention

The acoustic transducer to which the technology disclosed herein has been applied is formed in a compact and lightweight shape by using a cylindrical acoustic transducing element formed of a film-shaped material having an expanding and contracting action. Therefore, the acoustic transducer can generate a sound wave which directly reaches the eardrum or can collect sound at a place near the eardrum without a feeling of foreign materials in a case where a person wears the acoustic transducer on an ear.

Also, according to the acoustic transducer to which the technology disclosed herein has been applied, since the cylindrical acoustic transducing element also functions as an acoustic tube, re-reflection of the sound wave reflected by the eardrum can be prevented when the sound wave is generated. Therefore, localization phenomenon and a feeling of pressure in auditory sense can be prevented, and the sound can be listened as an excellent reproduced sound.

Furthermore, the effects described herein are only exemplary, and the effect of the present invention is not limited to these. Also, the present invention may have an additional effect in addition to the above effects.

Detailed description based on the embodiment to be described and the drawings would clarify another purpose, feature, and advantage of the technology disclosed herein.

MODE FOR CARRYING OUT THE INVENTION

An embodiment according to the technology disclosed herein is described in detail below with reference to the drawings.

Figure 1:
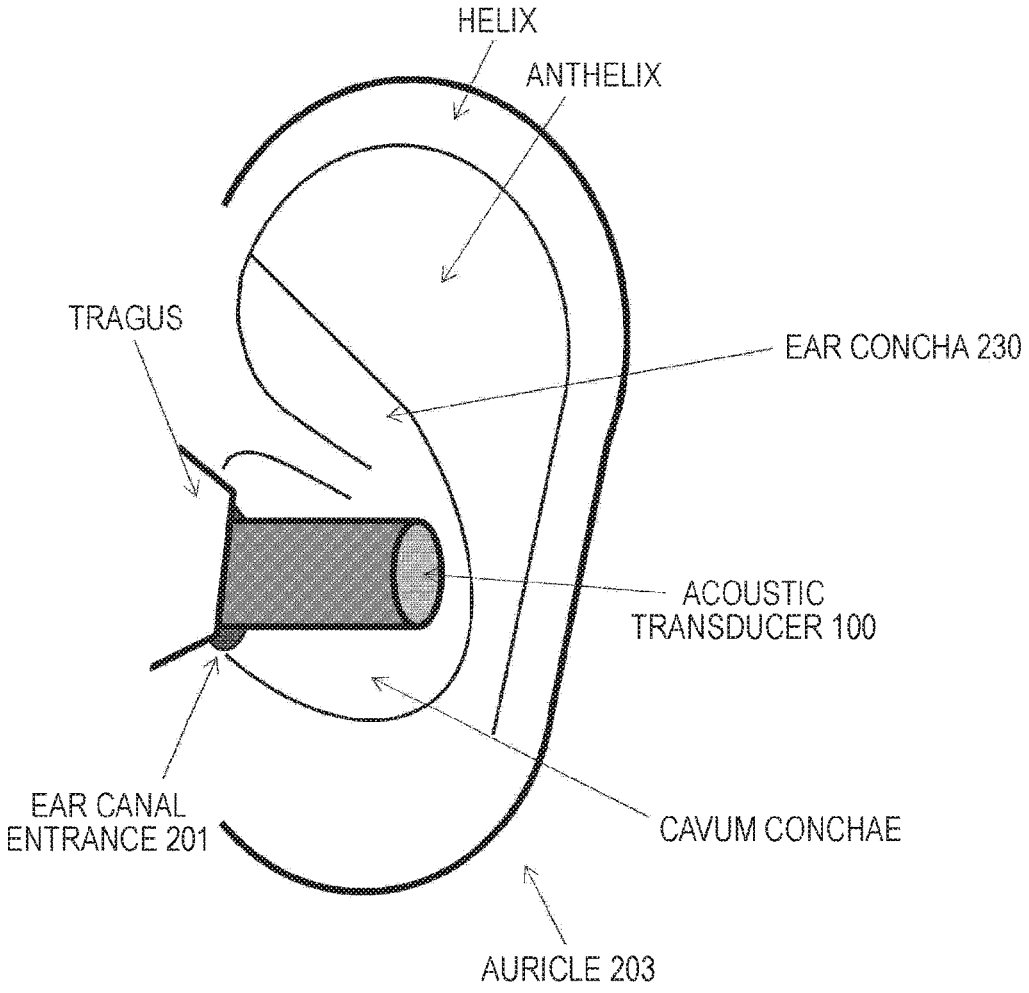
FIG. 1 is a diagram of a state where an acoustic transducer 100 to which the technology disclosed herein has been applied is worn on an auricle (left ear) of a person.

In FIG. 1, a state is illustrated in which an acoustic transducer 100 to which the technology disclosed herein has been applied is fitted into an auricle (left ear) of a person. Also, in FIG. 2, a vertical sectional view of a head (ear canal) of the person wearing the acoustic transducer 100 is illustrated.

An ear canal 200 is a hole which starts from an ear canal entrance 201 and ends at the inside of an eardrum 202. The length of the ear canal 200 is generally about 25 to 30 mm. In addition, an auricle 203 has a complicated uneven shape caused by a shape of an auricle cartilage and is positioned on the outside of the ear canal 200. A rough description of the structure of the auricle 203 includes a helix, an anthelix, an ear concha, and a tragus in order starting from the outer side of the auricle 203. The ear concha is a most concave part positioned at the center of the ear, and the ear canal entrance 201 is positioned near the tragus of the cavum conchae which is positioned in a lower half of the ear concha. The ear canal 200 generally meanders in an S-shape. However, the ear canal 200 is illustrated in a cylindrical shape in FIG. 2 for simplification.

The acoustic transducer 100 to which the technology disclosed herein has been applied includes a cylindrical acoustic transducing element 101 formed of a film-shaped material having an expanding and contracting action. The acoustic transducing element 101 can function as a reproduction device for generating a sound by the expanding and contracting action according to an electric signal and a sound collection device for converting vibration caused by the received sound wave into the electric signal (to be described below). The cylindrical acoustic transducing element 101 functions as a non-reflective type acoustic tube and the reproduction device. When generating the sound wave, the acoustic transducing element 101 can prevent re-reflection of the sound wave reflected by an eardrum. Therefore, localization phenomenon and a feeling of pressure in auditory sense can be prevented, and the sound can be listened as an excellent reproduced sound. Also, since the acoustic transducing element 101 as a basic component is formed in a compact and lightweight shape, the acoustic transducer 100 can generate the sound wave for directly reaching the eardrum or can collect the sound at a place near the eardrum without the feeling of foreign materials in a case where the person wears it on the ear.

Figure 3:
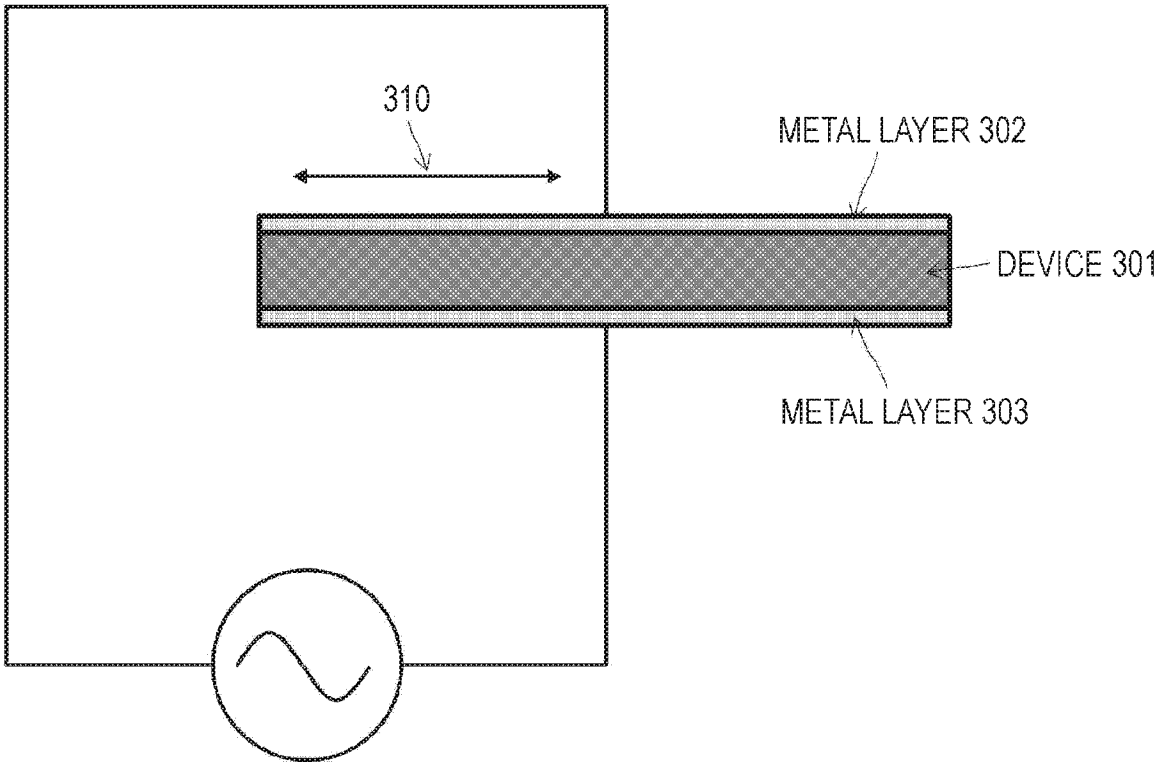
FIG. 3 is a diagram to describe a principle of a conversion action of an acoustic transducing element.

The acoustic transducing element 101 is formed by processing a sheet-shaped flexible device into a cylindrical shape. In FIG. 3, a diagram of a principle of a conversion action of the acoustic transducing element is illustrated. The acoustic transducing element includes a sheet-shaped flexible plane device 301 and metal layers 302 and 303 disposed on both surfaces of the device 301. Then, when an electric signal is applied between the metal layers 302 and 303 on both surfaces, the area of the device 301 is enlarged or reduced as indicated by a reference number 310 according to the polarity of the electric signal. The device 301 basically expands and contracts in a horizontal direction perpendicular to the electric field.

Furthermore, as the device 301 having the expanding and contracting action, for example, a structure can be used in which particles having piezoelectricity are dispersed in a flexible organic material (resin) (for example, refer to Patent Documents 3 and 4).

Figure 4:
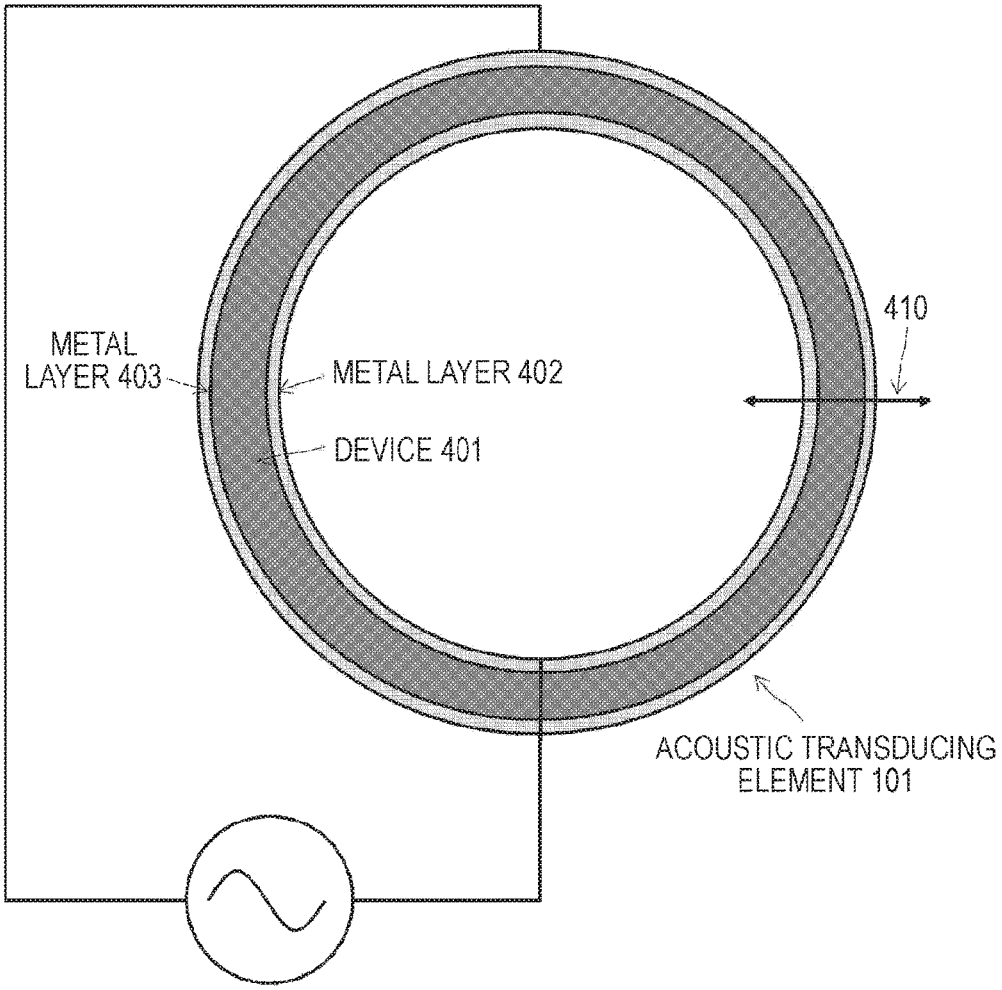
FIG. 4 is a sectional view of an acoustic transducing element 101.

FIG. 4 is a sectional view of the acoustic transducing element 101 formed by processing a sheet-shaped flexible device 401 illustrated in FIG. 3 into a cylindrical shape and forming metal layers 402 and 403 on the inner surface and the outer surface of the flexible device 401. Also, FIG. 5 is a longitudinal sectional view of the acoustic transducing element 101 illustrated in FIG. 4.

As illustrated in FIG. 3, in a case of the plane device 301, the electric signal is applied to the device 301 via the metal layers 302 and 303 on both side surfaces to expand and contract the device 301 in an area direction 310 according to the polarity. Whereas, in a case of the cylindrical device 401 illustrated in FIG. 4, the application of the electric signal expands and contracts the device 401 in a radial direction as indicated by a reference number 410 according to the polarity. Also, referring to FIG. 5, sound waves 511 and 512 are emitted in two directions toward exits at both ends in the cylinder by expanding and contracting movements 501 and 502 of the cylindrical device 401 in the radial direction.

Figure 5:
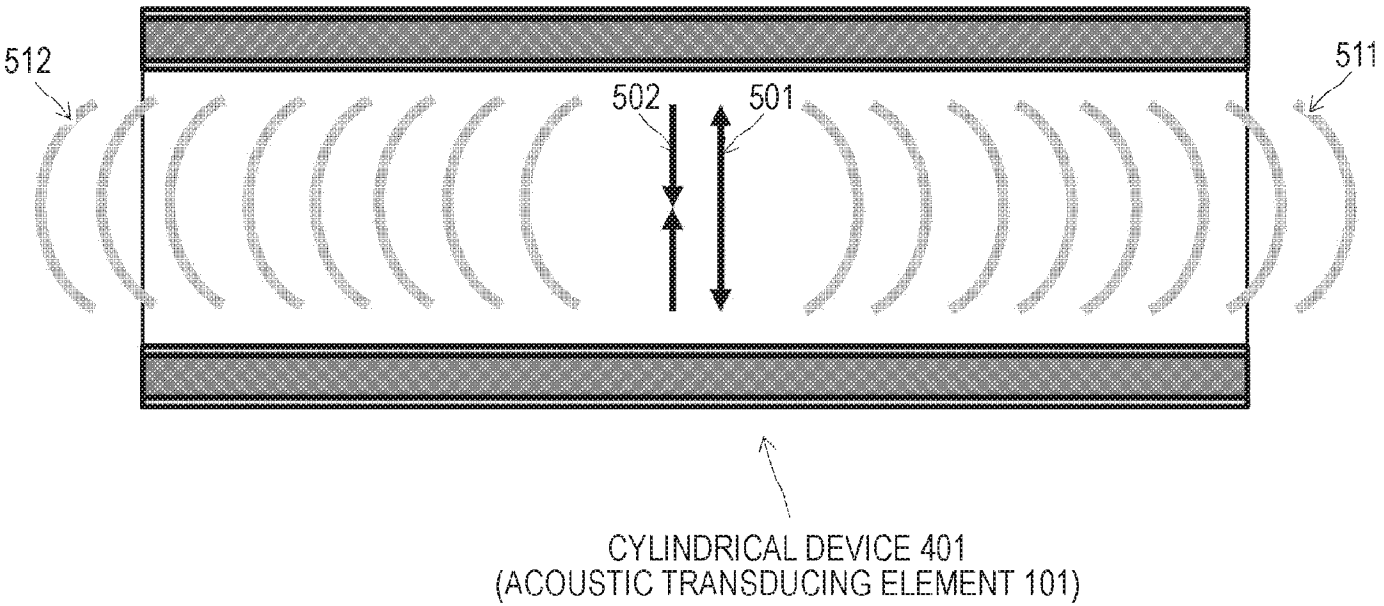
FIG. 5 is a view of a longitudinal cross-section of the acoustic transducing element 101 and an operation for converting an electric signal into a sound wave.

Also, the acoustic transducing element 101 configured as the cylindrical device 401 can function not only as a voice reproduction device (actuator) for converting the applied electric signal into the sound wave as illustrated in FIG. 5 but also as a sound collection device (transducer) for converting the input sound wave into the electric signal.

Figure 6:
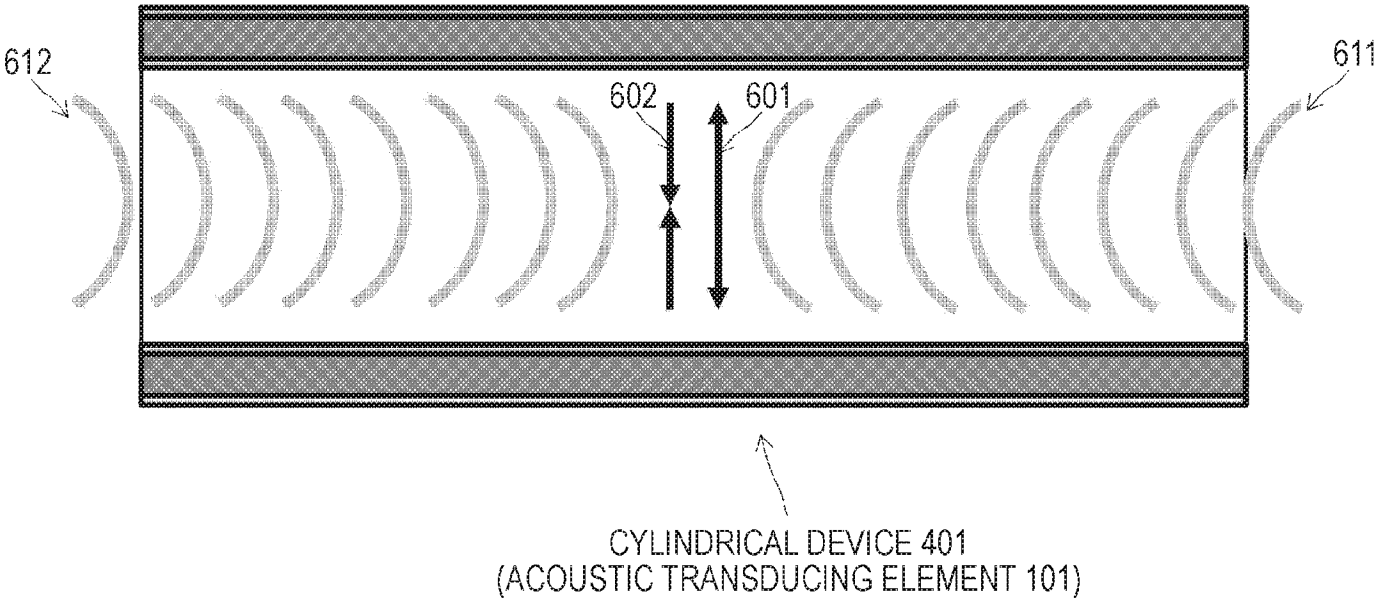
FIG. 6 is a view of a longitudinal cross-section of the acoustic transducing element 101 and an operation for converting the sound wave into the electric signal.

In FIG. 6, a state is illustrated in which sound waves 611 and 612 enter the cylindrical device 401 from entrances at both ends (or one end). The sound waves 611 and 612 which have entered the device 401 cause expansion and contraction of the cylindrical device 401 in the radial direction as indicated by reference numbers 601 and 602. Then, on the contrary to the movement illustrated in FIG. 4, a potential difference between the polarities according to the movement of the expansion and contraction of the cylindrical device 401 in the radial direction is generated between both side surfaces of the device 401, and the device 401 generates the electric signal according to the entered sound wave and functions as a transducer.

Referring to FIG. 2 again, the cylindrical acoustic transducing element 101 is formed to have an inner diameter W almost the same as an inner diameter $W_i$ of the ear canal 200. Strictly, the inner diameter W of the acoustic transducing element 101 is smaller than the inner diameter $W_i$ of the ear canal 200 by twice the thickness t of the sheet.

The acoustic transducing element 101 is formed as a long tubular body having the almost uniform inner diameter W in the longitudinal direction, that is, as an acoustic tube. The inside of the tube acts as a sound path through which the sound wave generated by the acoustic transducing element 101 is transmitted. When the inner diameter W of the acoustic transducing element 101 as the acoustic tube is almost the same as the inner diameter $W_i$ of the ear canal, one end of the acoustic transducing element 101 can be inserted into the ear canal entrance 201, and the sound wave emitted from the end of the acoustic transducing element 101 can enter the ear canal 200 without changing the acoustic impedance.

When the impedance in the tube of the acoustic transducing element 101 is almost the same as that of the ear canal 200, reflection of the sound caused by the change in the impedance generated when the sound reflected by the eardrum 202 goes out from the ear canal entrance 201 can be prevented, and the sound does not enter the ear canal 200 again. Therefore, it is preferable that the inner diameter W of the acoustic transducing element 101 be almost the same as an average inner diameter of the ear canal of the person.

It is supposed that the average value of the inner diameter $W_i$ of the ear canals of the adults is about 7.5 mm. Therefore, when the inner diameter W of the acoustic transducing element 101 is set to be from 6 to 9 mm, a difference between sectional areas of the acoustic transducing element 101 and the ear canal entrance 201 can be reduced, and the reflection is not caused. As a result, generation of a standing wave can be prevented, and an excellent acoustic characteristic can be obtained while preventing the reflected sound from reaching the eardrum 202.

On the other hand, it is supposed that another end of the tube of the acoustic transducing element 101 does not reflect the sounds. That is, the acoustic transducing element 101 is formed in a shape having almost the same inner diameter in the longitudinal direction and having a certain length.

In a word, the acoustic transducing element 101 is formed in a tube-like shape having the same inner diameter and a certain length. According to this, even when the sound reflected by the eardrum 202 enters the tube from one end, the sound is attenuated before the sound reaches the other end, and the sound is prevented from being reflected by the other end. Also, in the example illustrated in FIG. 2, both ends of the acoustic transducing element 101 are opened. Therefore, the reflected sound which has reached the other end is not reflected again and does not return to the ear canal 200.

Furthermore, as illustrated in FIG. 3, the basic components of the acoustic transducing element 101 are the device 301 which expands and contracts in response to the applied electric signal and the metal layers 302 and 303 to which the electric signals are applied from both side surfaces. The metal layers 302 and 303 are formed of, for example, a copper foil provided and stuck on the surface of the device 301. It is necessary for the copper foil to prevent peeling caused by a contact with external objects (for example, inner circumference of ear canal and finger of person for using acoustic transducer 100).

Figure 7:
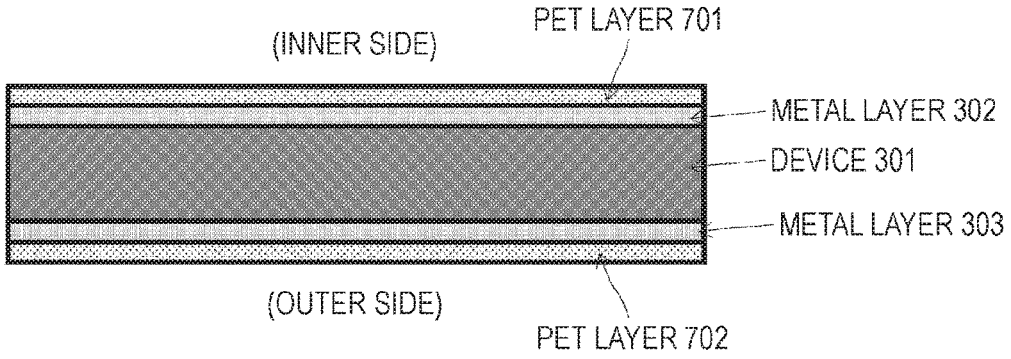
FIG. 7 is a diagram of an exemplary configuration of the acoustic transducing element 101 including protective PET layers disposed on an outer side a metal layer.
Figure 8:
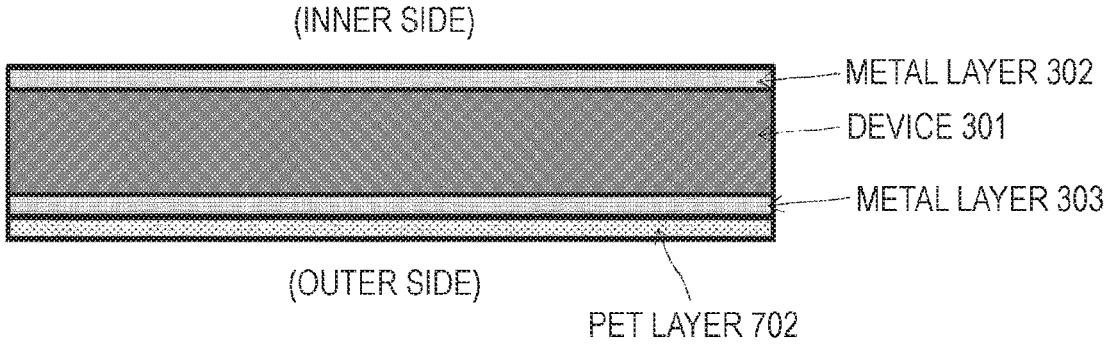
FIG. 8 is a diagram of an exemplary configuration of the acoustic transducing element 101 including a protective PET layer disposed on an outer side of the metal layer.
Figure 19:
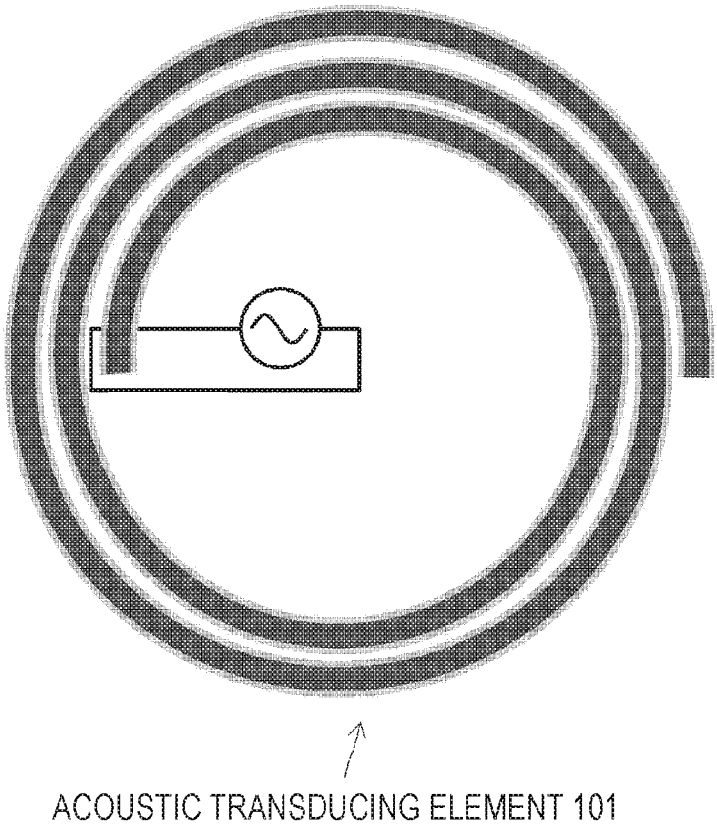
FIG. 19 is a diagram of an acoustic transducing element 101 formed by winding a single sheet of a flexible device in a spiral shape.

FIG. 7 is a diagram of an exemplary configuration of the acoustic transducing element 101 including protective polyethylene terephthalate (PET) layers 701 and 702 respectively disposed on an outer side of the metal layers 302 and 303. Also, in a case of the cylindrical acoustic transducing element 101 illustrated in FIGS. 1 and 2, the necessity for protection of the inner side of the metal layer 302 is low. Therefore, as illustrated in FIG. 8, the PET layer 702 may be disposed on the outer side surface of the metal layer 303. The acoustic transducing element 101 illustrated in FIG. 4 can be produced by rounding the sheet-shaped flexible device illustrated in FIGS. 7 and 8 into a cylindrical shape. Also, it is preferable that the cylindrical acoustic transducing element 101 be formed by laminating two or more layers, not a single layer, of the sheet-shaped flexible devices illustrated in FIGS. 7 and 8. For example, it is preferable that the single acoustic transducing element 101 be formed by concentrically superposing multiple cylinders, and the radius of one cylinder is made to be slightly larger than that of the inner cylinder (not shown). However, when the multiple cylinders are superposed, the cylinders are superposed so that the polarities of the layers coincide with each other. Alternatively, as illustrated in FIG. 19, the single acoustic transducing element 101 may be formed by preparing a single sheet of a flexible device and winding it in a spiral shape. In a case of the acoustic transducing element 101 having a spiral structure, all the layers of the devices are integrated. Therefore, the electric signal may be applied to a single position as illustrated in FIG. 19. In a case of the acoustic transducing element 101 having a multi-layer structure, when the electric signal is applied, expansion forces and contraction forces generated in each layer are accumulated. Therefore, a larger sound pressure can be obtained.

Figure 2:
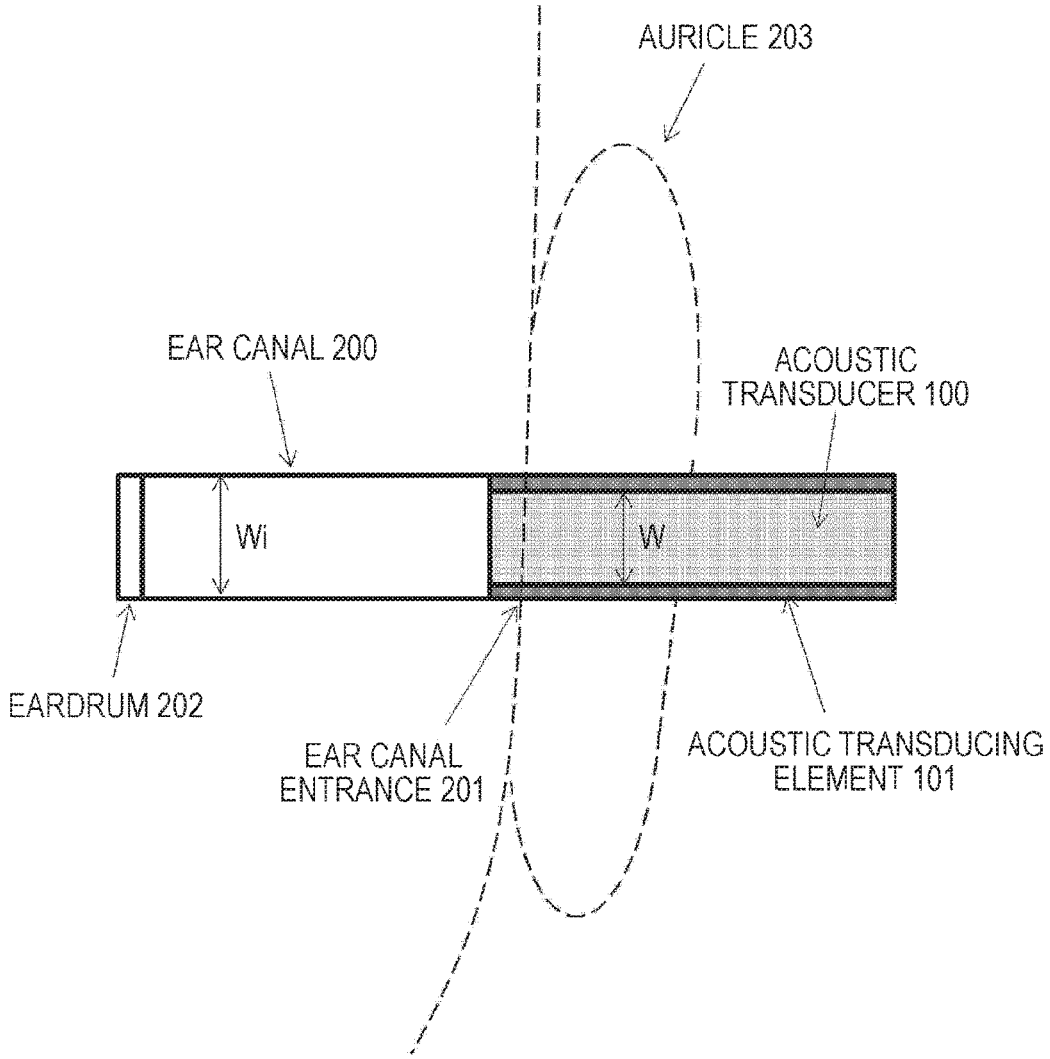
FIG. 2 is a vertical sectional view of a head (ear canal) of the person on which the acoustic transducer 100 is worn.
Figure 9:
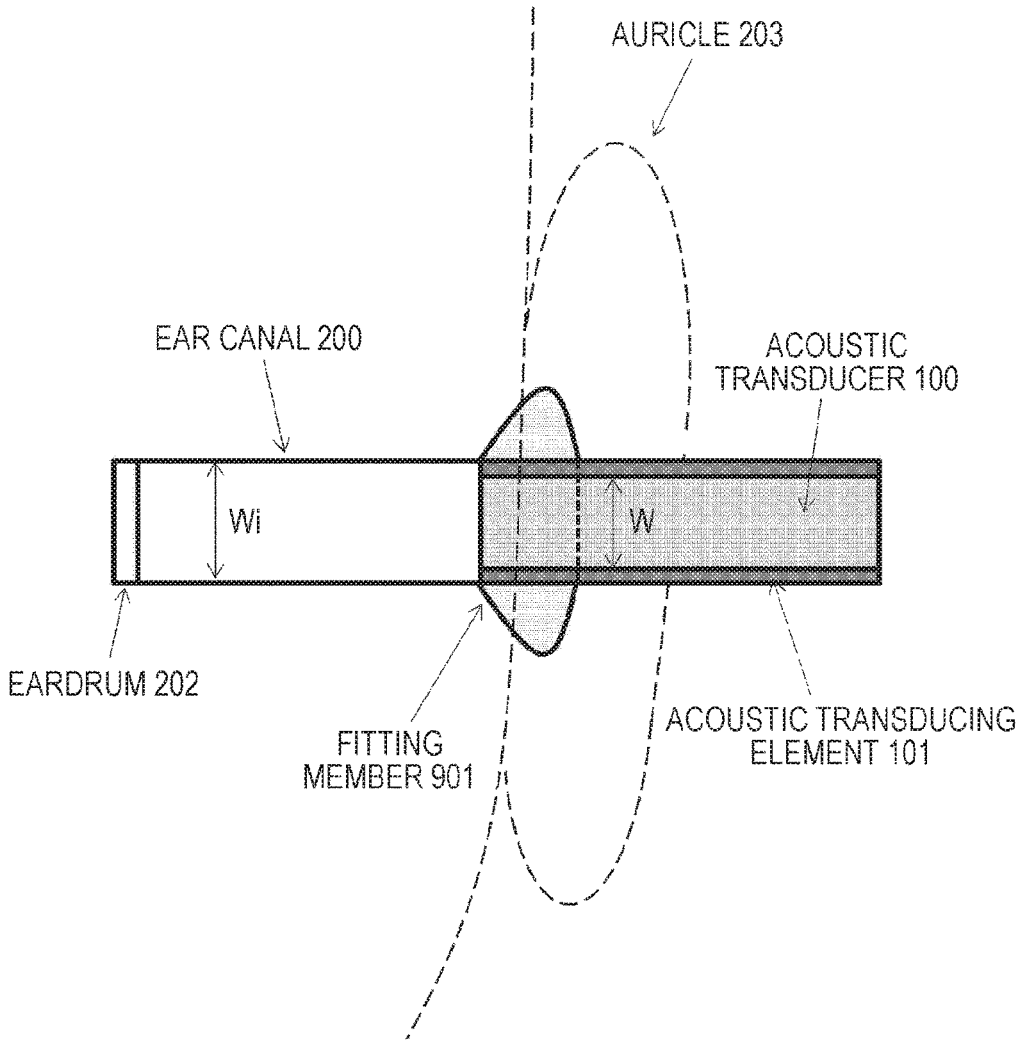
FIG. 9 is a diagram of a modification of the acoustic transducer 100.

In FIG. 9, a modification of the acoustic transducer 100 illustrated in FIG. 2 is illustrated. In the acoustic transducer 100 illustrated in FIG. 9, a fitting member (earpiece) 901 is disposed at one end side of the acoustic transducing element 101. The fitting member 901 is formed of a flexible synthetic resin or a rubber material. The fitting member 901 improves the feeling of fitting it into the auricle and prevents sound leakage from the vicinity of the ear canal entrance 201. Also, an inner diameter of the fitting member 901 is set to be the size which does not change the characteristic of the acoustic impedance in the cylinder of the acoustic transducing element 101.

Furthermore, the fitting member 901 can be detached from the acoustic transducing element 101 and can be exchanged. However, the fitting member 901 may be fixed to one end of the acoustic transducing element 101 or may be integrated with the acoustic transducing element 101.

Figure 10:
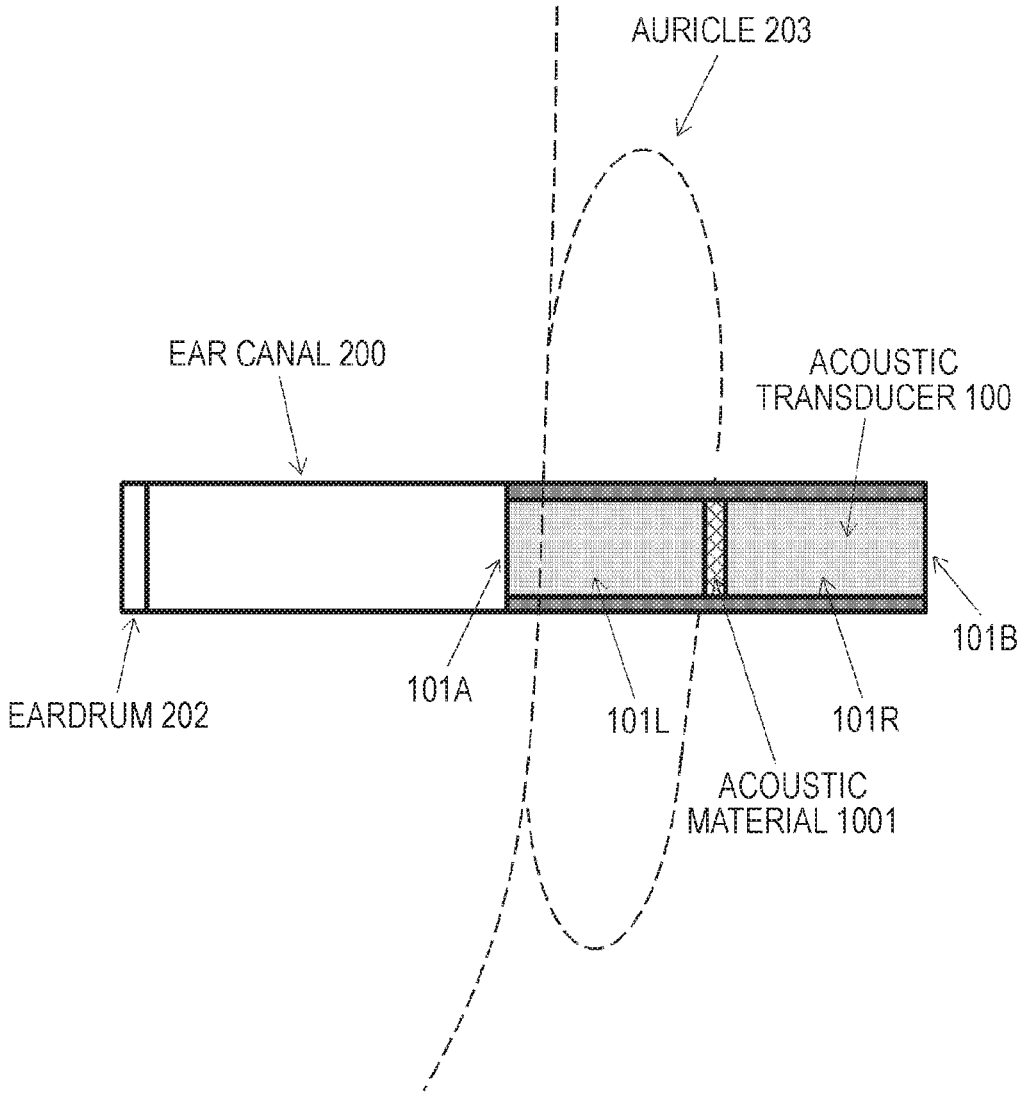
FIG. 10 is a diagram of another modification of the acoustic transducer 100.

Also, in FIG. 10, another modification of the acoustic transducer 100 illustrated in FIG. 2 is illustrated. In the acoustic transducer 100 illustrated in FIG. 10, an acoustic material 1001 for closing the cylinder of the acoustic transducing element 101 is disposed. That is, the acoustic transducer 100 illustrated in FIG. 10 is formed to promptly realize attenuation of the sound by using the acoustic material 1001. Therefore, even when a length of the acoustic transducing element 101 in the longitudinal direction is shortened, similarly to an earphone device having a long acoustic tube (for example, refer to Patent Document 2), the voice reflected by the eardrum is not reflected and is not listened again. Accordingly, the acoustic transducer 100 can be miniaturized. Also, since leakage of acoustic energy generated in the acoustic transducing element 101 to the outside is reduced, a bass part of the sound wave which enters the ear canal from the ear canal entrance can be enhanced.

Also, the acoustic material 1001 prevents the leakage of the sound generated in the acoustic transducing element 101 to the outside by promptly attenuating it. In addition, the acoustic material 1001 prevents the external sound from entering the acoustic transducing element 101, and the sound can be excellently listened. Conversely, in the exemplary configurations illustrated in FIGS. 2 and 9 in which the acoustic material is not used and the exit to the outside of the acoustic transducing element 101 is opened, there is an advantage such that external sounds can be concurrently listened when the sound generated in the acoustic transducing element 101 is listened.

In the exemplary configuration illustrated in FIG. 10, the acoustic material 1001 is disposed almost at the center of the cylinder configuring the acoustic transducing element 101. Also, the acoustic transducing element 101 has a cylindrical shape and has an even cross-sectional area in the longitudinal direction. Therefore, the acoustic characteristic does not change. In this case, it can be considered that acoustic impedances of a left part 101L and a right part 101R of the acoustic transducing element 101 divided by the acoustic material 1001 are almost the same. When it is assumed that the acoustic transducing element 101 generates almost uniform sound waves rightward and leftward (that is, the sound waves 511 and 512 which travel to the exits in opposite directions have the same sound qualities in FIG. 5), the same sounds can be listened from both the right and left ends of the acoustic transducing element 101. Therefore, when either one of the ends 101A and 101B of the acoustic transducing element 101 is inserted into the ear canal entrance, the same sound can be listened.

Figure 11:
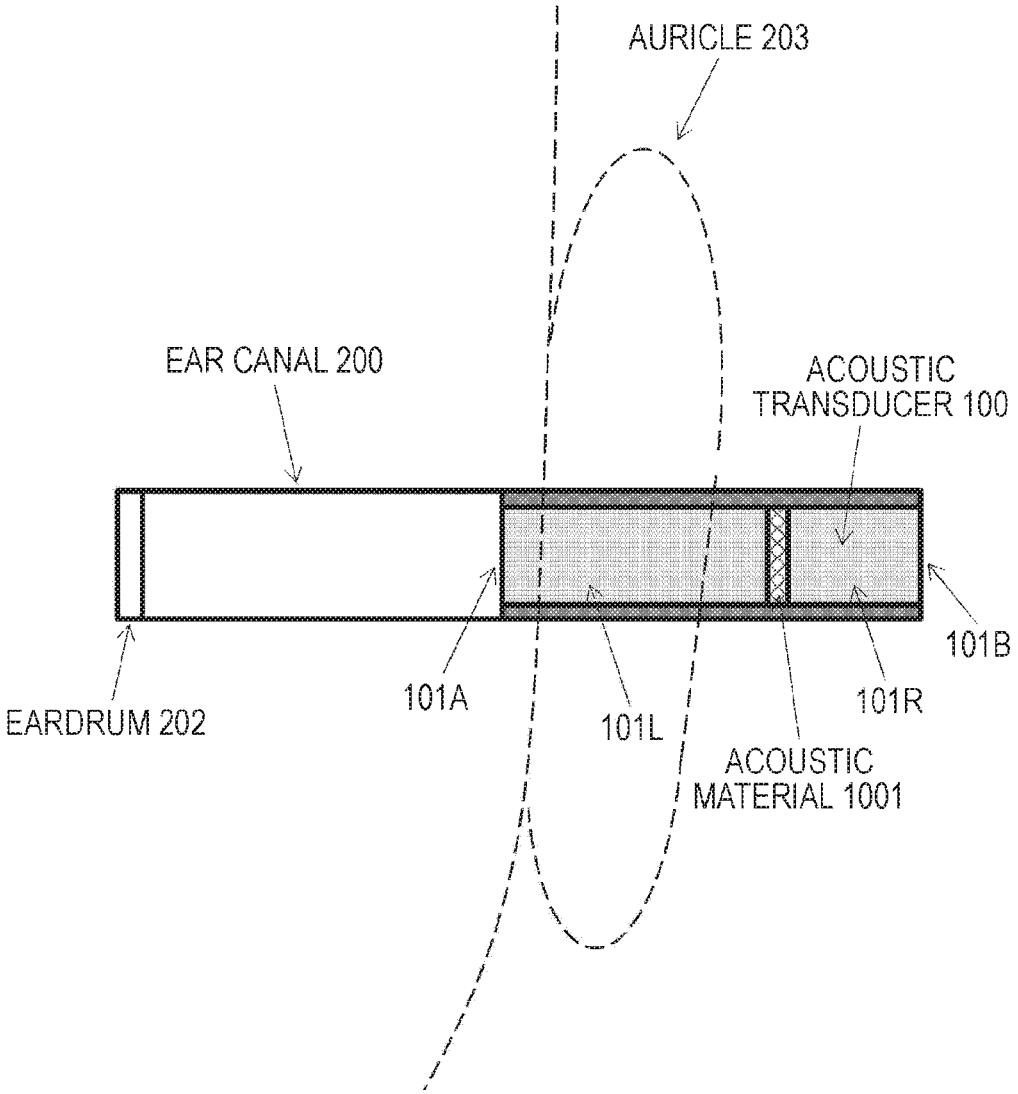
FIG. 11 is a diagram of a modification of the acoustic transducer 100 illustrated in FIG. 10.

Also, FIG. 11 is a diagram of a modification of the acoustic transducer 100 illustrated in FIG. 10. The acoustic material 100 is disposed on the right side of the vicinity of the center of the cylinder for forming the acoustic transducing element 101, and the left part 101L of the acoustic transducing element 101 gets longer, and the right part 10R gets shorter. Also, the acoustic impedances of the left and right parts become uneven. Therefore, use forms may be appropriately used according to the sound to be listened. For example, when the listener listens to music, it is preferable that the side of the end 101A be inserted into the ear canal entrance as illustrated in FIG. 11 to listen to the bass part by actively using the left part 101L having a long sound path. Whereas, when the listener wants to listen to a voice such as a radio broadcast DJ, it is preferable that the side of the end 101B be inserted into the ear canal entrance to remove the bass part which does not include a voice component by using the right part 101R having a short sound path.

In both exemplary configurations illustrated in FIGS. 10 and 11, the acoustic material 1001 is disposed in the acoustic transducing element 101, and the cylinder is closed. When either one of the ends 101A and 101B is inserted into the ear canal entrance, the same sound can be listened. Whereas, although this is not illustrated in the drawings, it is preferable that the acoustic material be arranged near the end on the opposite side of the ear canal entrance to close the acoustic transducing element 101. In this case, the end where the element 101 is not closed can be inserted into the ear canal entrance. Also, the acoustic transducing element 101 can enhance the bass components of the sound wave to the maximum as an acoustic tube.

Furthermore, although not illustrated in FIGS. 10 and 11, similarly to the example illustrated in FIG. 9, a fitting member (earpiece) may be attached to the end on the side of the ear canal entrance of the acoustic transducing element 101.

Also, the acoustic material 1001 may be movable in the longitudinal direction without fixing it to a certain place in the cylinder of the acoustic transducing element 101. In this case, while the acoustic transducer 100 is fitted into the ear, the position of the acoustic material 1001 is moved to change the distance from each of the left and right exits. Accordingly, the volume in the ear canal and the cylinder of the acoustic transducing element 101 is changed, and a frequency characteristic of the sound wave for entering from the ear canal entrance can be adjusted.

Figure 12A:
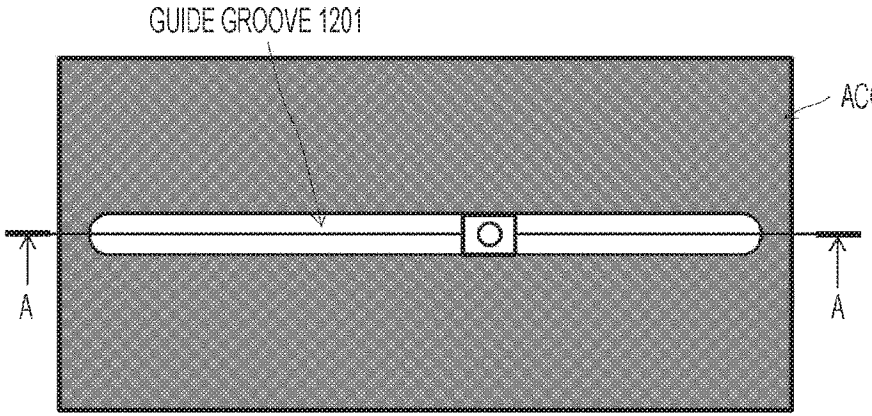
FIGS. 12(*a*) to 12(*c*) are diagrams of an exemplary configuration of an acoustic transducing element 101 including a moving mechanism of an acoustic material 1001.
Figure 12B:
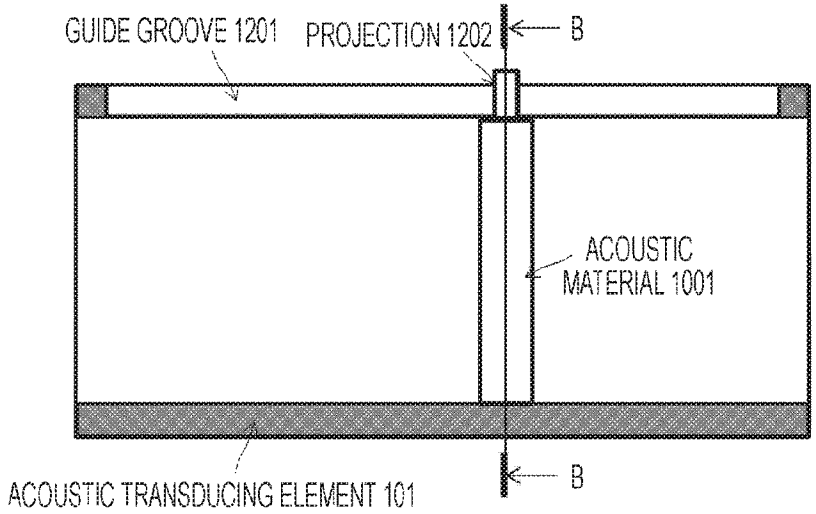
Figure 12C:
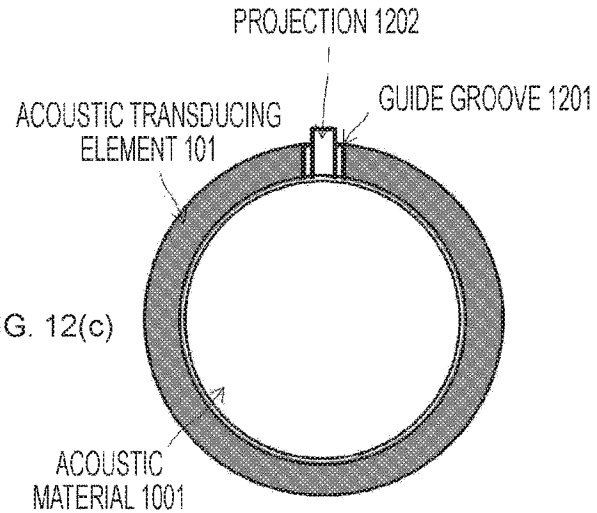

In FIGS. 12(*a*) to 12(*c*), an exemplary configuration of an acoustic transducing element 101 including a moving mechanism of an acoustic material 1001 is illustrated. FIG. 12(*a*) is a top view of the acoustic transducing element 101. Also, FIG. 12(*b*) is a sectional view of the acoustic transducing element 101 in the longitudinal direction cut along a line A-A. Also, FIG. 12(*c*) is a cross-sectional view of the acoustic transducing element 101 cut along a line B-B.

As illustrated in FIG. 12(*a*), a linear guide groove 1201 is provided in the cylindrical acoustic transducing element 101 in the longitudinal direction. Also, the disk-shaped acoustic material 1001 is inserted into the cylinder of the acoustic transducing element 101. As it is shown in FIGS. 12(*b*) and 12(*c*), a projection 1202 is formed at a single part of a periphery of the acoustic material 1001. As it is shown in FIGS. 12(*a*) to (*c*), the projection 1202 is inserted into the guide groove 1201, and a front end part of the projection 1202 is exposed to external environment from the guide groove 1201.

A wearer of the acoustic transducer 100 can move the acoustic material 1001 by operating the projection 1202 with a fingertip and the like. The movement of the projection 1202, that is, the acoustic material 1001 is regulated by the linear guide groove 1201. By moving the position of the acoustic material 1001 along the longitudinal direction of the acoustic transducing element 101 by operating the projection 1202, a position where the acoustic transducing element 101 is closed can be freely changed.

Figure 13:
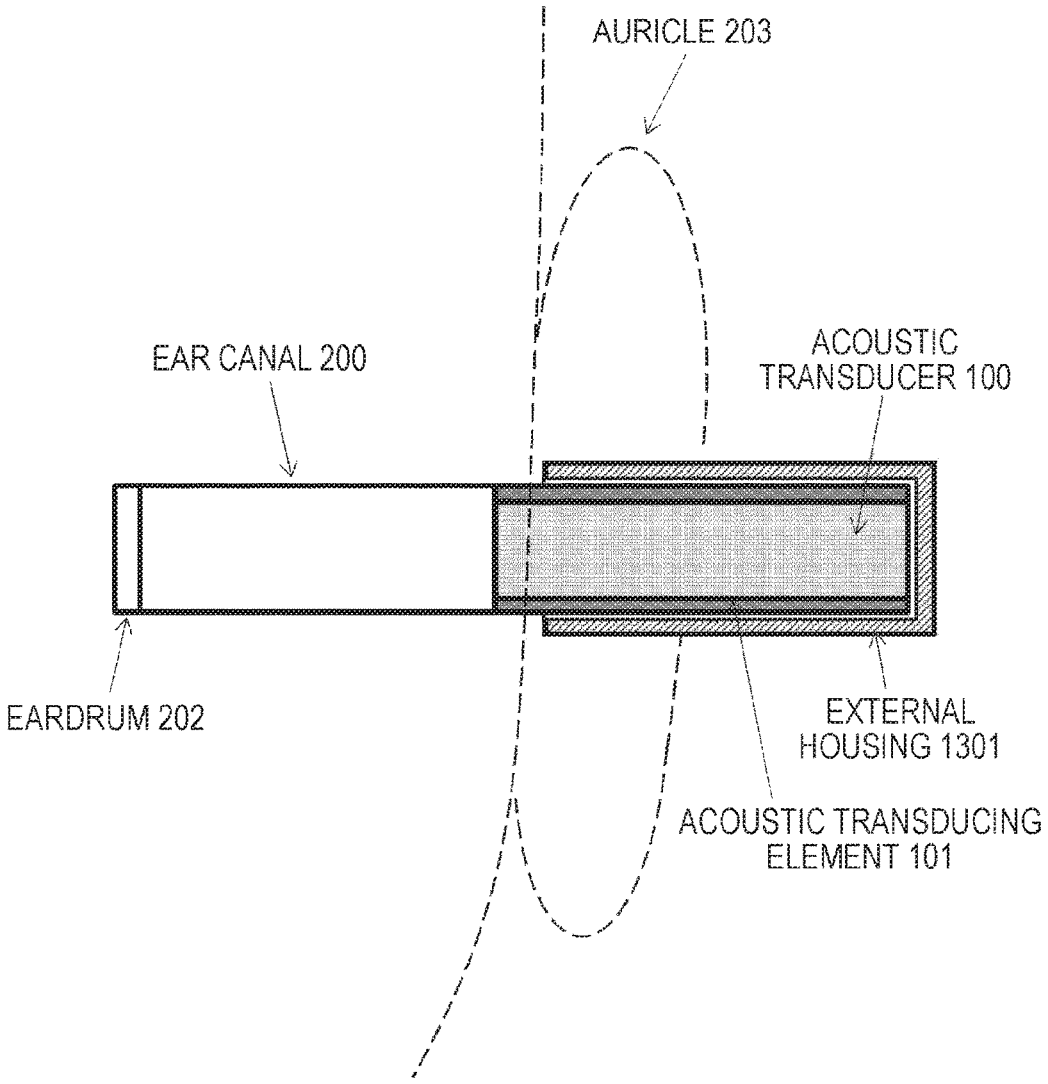
FIG. 13 is a diagram of still another modification of the acoustic transducer 100.

In FIG. 13, still another modification of the acoustic transducer 100 illustrated in FIG. 2 is illustrated. The acoustic transducer 100 illustrated in FIG. 13 includes an external housing 1301, which is attached to the outside of the cylindrical acoustic transducing element 101, to keep the shape. As illustrated in FIGS. 7 and 9, the acoustic transducing element 101 is a soft structure in which the metal layer such as the copper foil and the PET layer are formed on both side surfaces of the flexible device. The external housing 1301 is a comparatively strong structure which has a cylindrical shape having an inner diameter larger than the outer shape of the acoustic transducing element 101. The external housing 1301 holds the acoustic transducing element 101 by inserting it into the external housing 1301. Accordingly, even when the acoustic transducing element 101 is flexible and soft, deformation of the acoustic transducing element 101 caused by a physical pressure from outside can be prevented. A purpose for providing the external housing 1301 is to hold the acoustic transducing element 101. Therefore, the external housing 1301 may be sealed and may open the acoustic transducing element 101 to outside as a net. When the external housing 1301 is sealed, an effect on preventing the sound wave from being emitted outside from the acoustic transducing element 101 is obtained by closing an exit on the opposite side of the ear canal entrance of the acoustic transducing element 101. Also, the external housing 1301 has an effect on preventing the sound wave from entering the acoustic transducing element 101 from outside.

The external housing 1301 may be formed as a removable cap for closing an opening end of the cylindrical acoustic transducing element 101.

Figure 14:
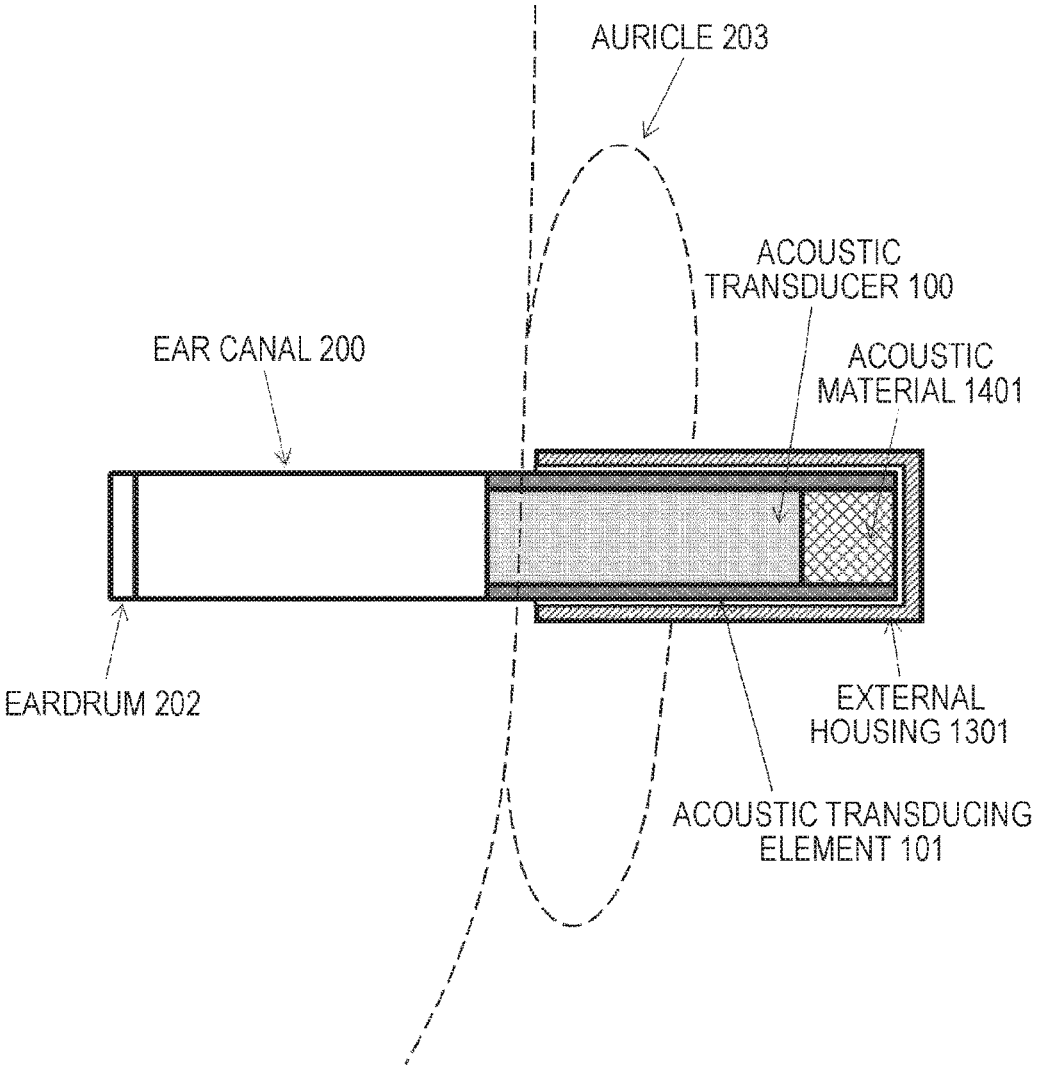
FIG. 14 is a diagram of a modification of the acoustic transducer 100 illustrated in FIG. 13.

In FIG. 14, a modification of the acoustic transducer 100 illustrated in FIG. 13 is illustrated. In the example illustrated in FIG. 14, an acoustic material 1401 is inserted into the cylindrical acoustic transducing element 101. The external housing 1301 is a structure which has a cylindrical shape having an inner diameter larger than the outer shape of the acoustic transducing element 101. The external housing 1301 holds the acoustic transducing element 101 by inserting it into the external housing 1301. Accordingly, even when the acoustic transducing element 101 is flexible and soft, deformation of the acoustic transducing element 101 caused by a physical pressure from outside can be prevented. A purpose for providing the external housing 1301 is to hold the acoustic transducing element 101. Therefore, the external housing 1301 may be sealed and may open the acoustic transducing element 101 to outside as a net. When the external housing 1301 is sealed, an effect on preventing the sound wave from being emitted outside from the acoustic transducing element 101 is obtained. Also, the acoustic material 1401 prevents that the sound wave generated by the acoustic transducing element 101 is reflected after the sound wave has reached the eardrum 202 and enters the eardrum 202 by being re-reflected in the acoustic transducing element 101.

Figure 15:
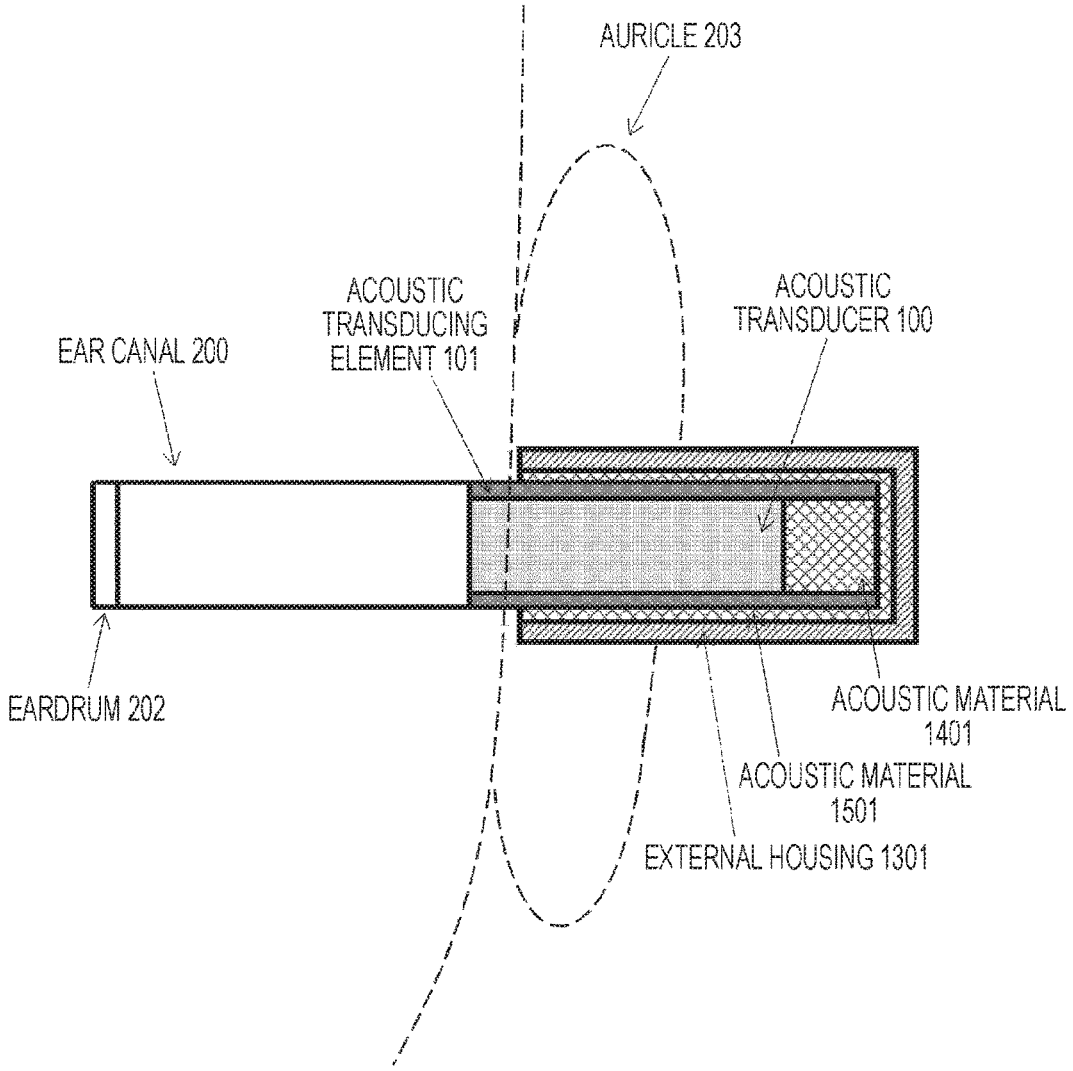
FIG. 15 is a diagram of a modification of the acoustic transducer 100 illustrated in FIG. 14.

Also, in FIG. 15, a modification of the acoustic transducer 100 illustrated in FIG. 14 is illustrated. In the example in FIG. 15, an acoustic material 1501 is disposed in a gap between the cylindrical acoustic transducing element 101 and the external housing 1301 where the acoustic transducing element 101 is inserted. The external housing 1301 is a structure which has a cylindrical shape having an inner diameter larger than the outer shape of the acoustic transducing element 101. The external housing 1301 holds the acoustic transducing element 101 by inserting it into the external housing 1301. Accordingly, even when the acoustic transducing element 101 is flexible and soft, deformation of the acoustic transducing element 101 caused by a physical pressure from outside can be prevented. A purpose for providing the external housing 1301 is to hold the acoustic transducing element 101. Therefore, the external housing 1301 may be sealed and may open the acoustic transducing element 101 to outside as a net. When the external housing 1301 is sealed, an effect on preventing the sound wave from being emitted outside from the acoustic transducing element 101 is obtained. The acoustic material 1401 prevents that the sound wave generated by the acoustic transducing element 101 is reflected after the sound wave has reached the eardrum 202 and enters the eardrum 202 by being re-reflected in the acoustic transducing element 101. Also, the acoustic material 1501 has an effect on preventing the sound wave generated by the acoustic transducing element 101 from being emitted outside from the outer periphery.

Furthermore, although not illustrated in FIGS. 13 to 15, similarly to the example illustrated in FIG. 9, a fitting member (earpiece) may be attached to the end on the side of the ear canal entrance of the acoustic transducing element 101.

Figure 16:
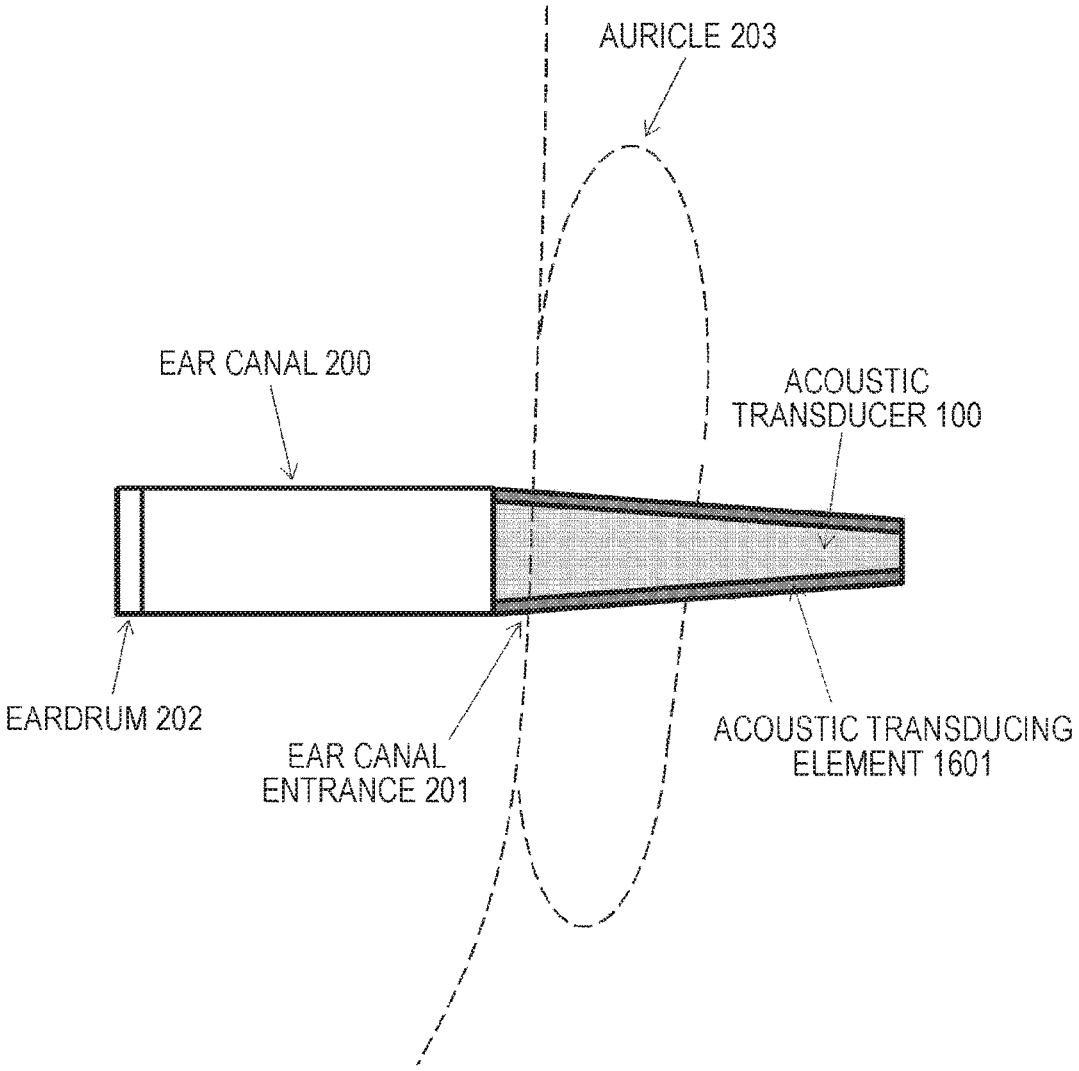
FIG. 16 is a diagram of yet another modification of the acoustic transducer 100.

In FIG. 16, yet another modification of the acoustic transducer 100 illustrated in FIG. 2 is illustrated. In the exemplary configurations illustrated in FIGS. 10, 11, and 12(*a*) to 12(*c*), the acoustic transducing element 101 has a uniform cross-sectional area in the longitudinal direction, for example, as a cylindrical shape, and the acoustic material 1001 is squeezed into the acoustic transducing element 101. Then, the acoustic transducing element 101 can prevent the leakage of the sound generated by the acoustic transducing element 101 to the outside. Whereas, in the example illustrated in FIG. 16, a hollow acoustic transducing element 1601 has a shape with a cross-sectional area which is gradually decreased as moving in the longitudinal direction, such as a conical shape. In this case, the sound wave reflected by the eardrum is hardly emitted to the outside even when the sound wave is re-reflected by the acoustic transducing element 1601. Therefore, although the acoustic transducing element 1601 has an opening end, the leakage of the sound generated by the acoustic transducing element 1601 to the outside can be prevented without providing an acoustic material.

Furthermore, although not illustrated in FIG. 16, similarly to the example illustrated in FIG. 9, a fitting member (earpiece) may be attached to the end on the side of the ear canal entrance of the acoustic transducing element 101.

Figure 17:
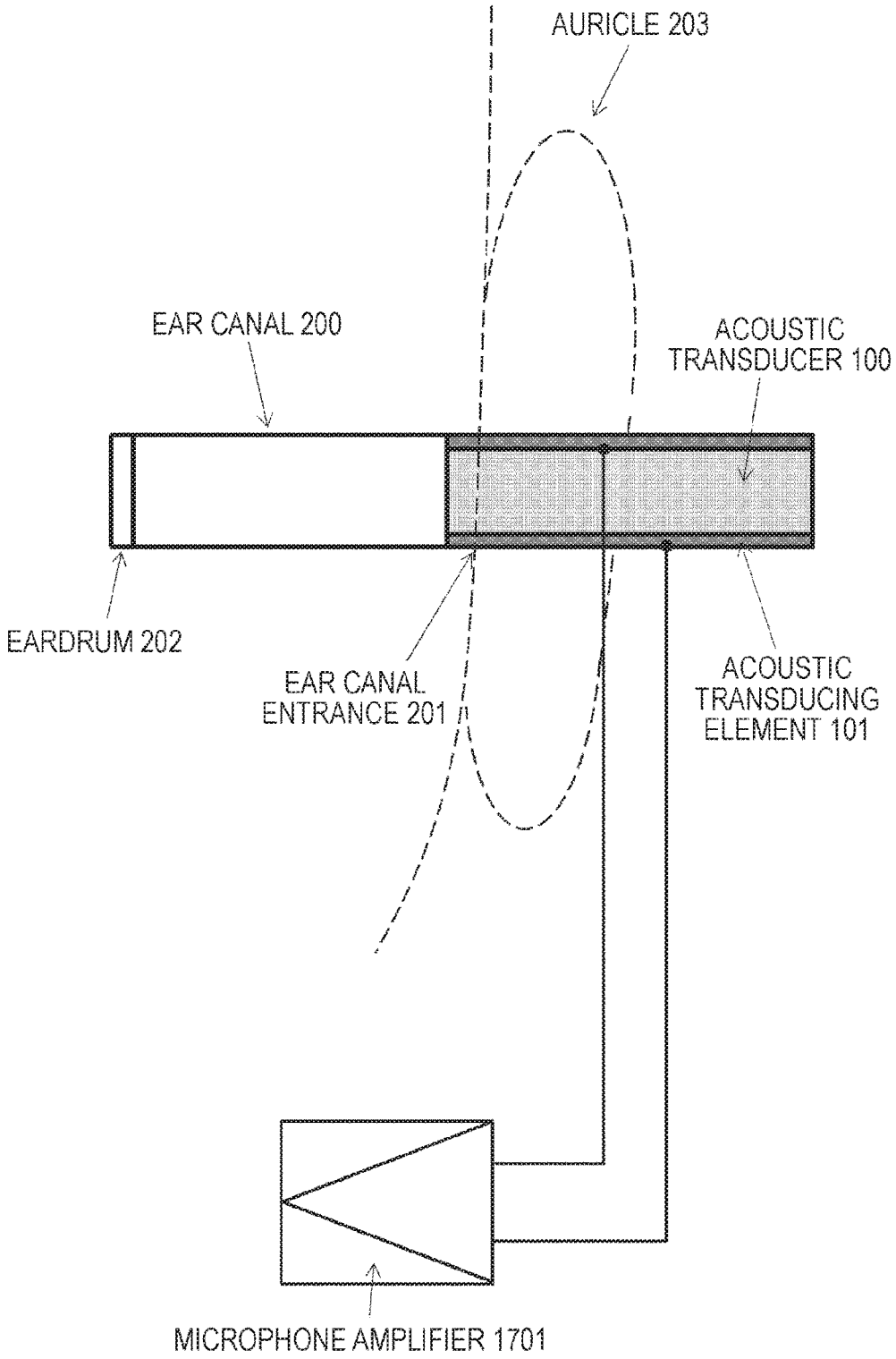
FIG. 17 is a diagram of still yet another modification (example of acoustic transducer used as microphone) of the acoustic transducer 100.

In FIG. 17, still yet another modification of the acoustic transducer 100 illustrated in FIG. 2 is illustrated. As already described with reference to FIG. 6, the cylindrical acoustic transducing element 101 can be used as a transducer for converting the sound wave which has entered the cylinder from the end into the electric signal. In the example illustrated in FIG. 17, the acoustic transducer 100 is used as a microphone. That is, the electric signal according to the sound wave can be captured by connecting metal layers on an inner surface and an outer surface of the acoustic transducing element 101 to respective input terminals of a microphone amplifier 1701. By fitting the microphones having the configuration illustrated in FIG. 17 into both ears, the microphone can be used to collect the sound as a dummy head microphone or a binaural microphone to be fitted into ears of a person. The acoustic transducer 100 illustrated in FIG. 17 does not include an acoustic material in the acoustic transducing element 101. Therefore, the ear canal entrance is opened. Accordingly, the sound can be collected while an external sound is listened by a real ear.

Figure 18:
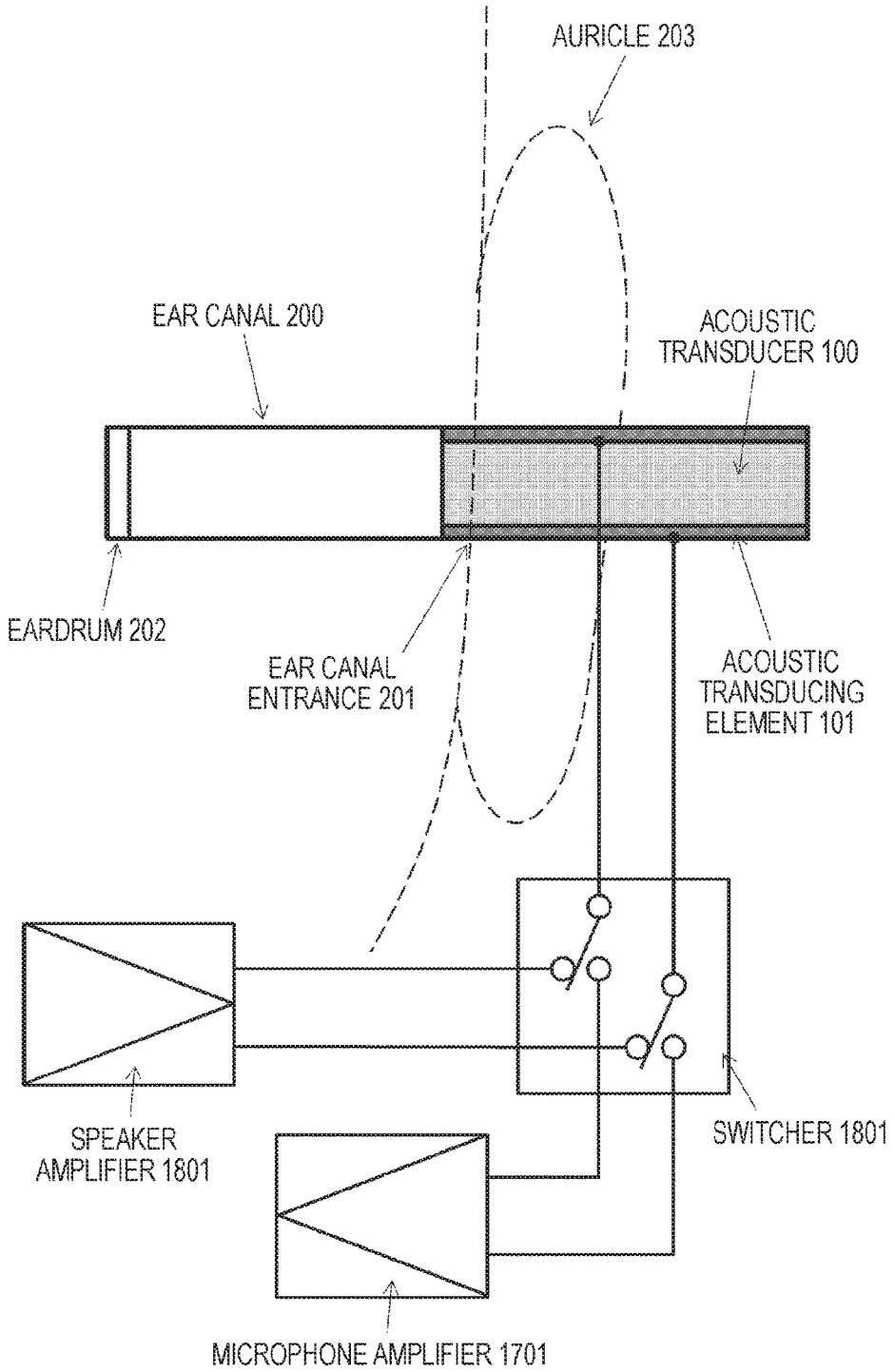
FIG. 18 is a diagram of a modification of the acoustic transducer 100 illustrated in FIG. 17.

In FIG. 18, a modification of the acoustic transducer 100 illustrated in FIG. 17 is illustrated. In the example illustrated in FIG. 18, an output to a microphone amplifier 1701 and to a speaker amplifier 1801 is switched by a switcher 1800. The microphone amplifier 1701 inputs the electric signals from the inner and outer metal layers of the acoustic transducing element 101 by the respective input terminals, and the speaker amplifier 1801 outputs the electric signals from the respective output terminals to the inner and outer metal layers of the acoustic transducing element 101. That is, in the example illustrated in FIG. 18, the acoustic transducer 100 can function as both the voice reproduction device and the sound collection device.

Furthermore, although not illustrated in FIGS. 17 and 18, similarly to the example illustrated in FIG. 9, a fitting member (earpiece) may be attached to the end on the side of the ear canal entrance of the acoustic transducing element 101.

In this way, the acoustic transducer 100 according to the present embodiment has a simple, compact, and lightweight configuration and is operated as a non-reflective type headphone. Also, the acoustic transducer 100 has an excellent sound image localization, and a listener can listen to an external sound while listening to a sound. In addition, the acoustic transducer 100 can be also operated as a binaural microphone.

CITATION LIST

Patent Document

Patent Document 1: Japanese Patent Application Laid-Open No. 2007-189468

Patent Document 2: Japanese Patent No. 2829982

Patent Document 3: Japanese Patent Application Laid-Open No. 2009-59842

Patent Document 4: Japanese Patent Application Laid-Open No. 2014-14063

INDUSTRIAL APPLICABILITY

The technology disclosed herein has been described in detail with reference to the specific embodiment. However, it is obvious that those skilled in the art can modify and substitute the embodiment without departing from the scope of the technology disclosed herein.

In the present specification, the embodiment has been mainly described in which the cylindrical or conical acoustic transducing element is formed by using the sheet-shaped flexible device having an area enlarged or reduced in response to the characteristic of the electric signal to be applied. However, the scope of the technology disclosed herein is not limited to this. By using the similar device, an acoustic transducer having a similar acoustic characteristic can be realized by using an acoustic transducing element formed in various hollow shapes other than a cylinder and a circular cone.

In a word, the technology disclosed herein has been described as a form of an example, and the contents of the present description should not be restrictively interpreted. That is, claims should be taken into consideration in order to determine the scope of the technology disclosed herein.

Note that the technology disclosed herein can have the following configurations.

(1) An acoustic transducer including:

an acoustic transducing unit configured to be formed to have an inner diameter almost the same as an inner diameter of an ear canal of a person and to have an expanding and contracting action; and a part inserted into an ear canal configured to be provided at least one end of the acoustic transducing unit.

(1-1) The acoustic transducer according to (1), wherein the acoustic transducing unit is a long tubular body having an almost uniform inner diameter.

(1-2) The acoustic transducer according to (1), wherein the acoustic transducing unit includes a sheet-shaped flexible device which is formed in a hollow form and has an expanding and contracting action according to an electric signal, a first metal layer which is disposed on an inner peripheral side of the flexible device, a second metal layer which is disposed on an outer peripheral side of the flexible device, and an amplifier which outputs an electric signal to be applied between the first and second metal layers or inputs an electric signal generated between the first and second metal layers.

(1-3) The acoustic transducer according to (1-2), wherein a protective layer formed of PET or other material is disposed on at least one of the first and second metal layers.

(2) The acoustic transducer according to (1), wherein both exits of the acoustic transducing unit are opened.

(3) The acoustic transducer according to (1), further including:

a fitting member configured to be included in the part inserted into an ear canal.

(3-1) The acoustic transducer according to (3), wherein an inner diameter of the fitting member is set to a size which does not change a characteristic of an acoustic impedance in the acoustic transducing unit.

(4) The acoustic transducer according to (1), wherein the acoustic transducing unit is closed.

(5) The acoustic transducer according to (1), wherein the acoustic transducing unit is closed, and both ends of the acoustic transducing unit are the parts inserted into ear canals.

(6) The acoustic transducer according to (1), wherein one end of the acoustic transducing unit is closed, and the other end is the part inserted into an ear canal.

(7) The acoustic transducer according to (1), wherein the acoustic transducing unit is closed, and a closed position is variable.

(8) The acoustic transducer according to any one of (4) to (7), further including:

an acoustic material configured to seal the inside or the end of the acoustic transducing unit.

(9) The acoustic transducer according to (1), wherein the inside of the acoustic transducing unit has an almost uniform cross-sectional area in a longitudinal direction.

(10) The acoustic transducer according to (1), wherein the cross-sectional area of the inside of the acoustic transducing unit is gradually decreased in the longitudinal direction.

(11) The acoustic transducer according to (1), further including:

an external housing configured to be provided outside the acoustic transducing unit.

(12) The acoustic transducer according to (11), wherein the external housing closes an exit on an opposite side of the part inserted into an ear canal of the acoustic transducing unit.

(13) The acoustic transducer according to (11) or (12), wherein the external housing has an inner diameter larger than an outer shape of the acoustic transducing unit and holds the acoustic transducing unit by inserting the acoustic transducing unit into the external housing.

(14) The acoustic transducer according to (13), further including:

an acoustic material configured to be provided in a gap between the external housing and the acoustic transducing unit.

(15) The acoustic transducer according to (1), wherein the acoustic transducing unit functions as a reproduction device.

(16) The acoustic transducer according to (1), wherein the acoustic transducing unit functions as a sound collection device.

(17) The acoustic transducer according to (1), wherein the acoustic transducing unit functions as both the reproduction device and the sound collection device.

(18) The acoustic transducer according to (1), wherein the acoustic transducing unit is formed of a sheet-shaped flexible device having an expanding and contracting action according to an electric signal.

REFERENCE SIGNS LIST

100 acoustic transducer
101 acoustic transducing element
301 sheet-shaped flexible device
302, 303 metal layer
401 sheet-shaped flexible device
402, 403 metal layer
701, 702 PET layer
901 fitting member (earpiece)
1301 external housing
1401 acoustic material (for inside of acoustic transducing element)
1501 acoustic material (for outer periphery of acoustic transducing element)
1601 acoustic transducing element (conical shape)
1701 microphone amplifier
1800 switcher
1801 speaker amplifier

The invention claimed is:

1. An acoustic transducer, comprising:

an acoustic transducing unit that has an inner diameter smaller than an inner diameter of a user's ear canal, wherein the acoustic transducing unit comprises a linear guide groove; and a first acoustic material within the acoustic transducing unit, wherein the first acoustic material is movable in a longitudinal direction of the acoustic transducing unit by use of the linear guide groove.

2. The acoustic transducer according to claim 1, wherein the acoustic transducing unit has two ends that are open.

3. The acoustic transducer according to claim 1, further comprising a fitting member at an end of the acoustic transducer, for insertion into the user's ear canal.

4. The acoustic transducer according to claim 1, wherein the acoustic transducing unit is closed.

5. The acoustic transducer according to claim 1, wherein:

the acoustic transducing unit is closed, the acoustic transducing unit has two ends, and each of the two ends is compatible with the user's ear canal.

6. The acoustic transducer according to claim 1, wherein:

the acoustic transducing unit has two ends, a first end of the two ends is closed, and a second end of the two ends is compatible with the user's ear canal.

7. The acoustic transducer according to claim 4, wherein the acoustic transducing unit is closed by the first acoustic material.

8. The acoustic transducer according to claim 4, wherein the first acoustic material seals the acoustic transducing unit, at one of an end or a position between two ends of the acoustic transducing unit.

9. The acoustic transducer according to claim 1, wherein a cross sectional area of an inside of the acoustic transducing unit is uniform in the longitudinal direction.

10. The acoustic transducer according to claim 1, wherein a cross-sectional area of an inside of the acoustic transducing unit is gradually decreased in the longitudinal direction.

11. The acoustic transducer according to claim 1, further comprising:

an external housing outside the acoustic transducing unit.

12. The acoustic transducer according to claim 11, wherein:

the acoustic transducing unit has two ends, the external housing closes a first end of the two ends, the first end is opposite to a part of the acoustic transducer, and the part is compatible with the user's ear canal.

13. The acoustic transducer according to claim 11, wherein:

the external housing has an inner diameter larger than an outer shape of the acoustic transducing unit, and the external housing holds the acoustic transducing unit.

14. The acoustic transducer according to claim 13, further comprising a second acoustic material in a gap between the external housing and the acoustic transducing unit.

15. The acoustic transducer according to claim 1, wherein the acoustic transducing unit is configured to function as a reproduction device.

16. The acoustic transducer according to claim 1, wherein the acoustic transducing unit is configured to function as a sound collection device.

17. The acoustic transducer according to claim 1, wherein the acoustic transducing unit is configured to function as a reproduction device and as a sound collection device.

18. The acoustic transducer according to claim 1, wherein:

the acoustic transducing unit is of a sheet-shaped flexible device, and the sheet-shaped flexible device is configured to expand and contract based on an electric signal.

* * * * *